United States Patent [19]

Wixon

[11] 4,260,651

[45] Apr. 7, 1981

[54] PHOSPHATE-FREE CONCENTRATED PARTICULATE HEAVY DUTY LAUNDRY DETERGENT

[75] Inventor: Harold E. Wixon, New Brunswick, N.J.

[73] Assignee: Colgate-Palmolive Company, New York, N.Y.

[21] Appl. No.: 747,002

[22] Filed: Dec. 2, 1976

[51] Int. Cl.[3] ..... C02B 1/44; C11D 3/10; C11D 3/12; C11D 11/00

[52] U.S. Cl. ..... 427/214; 23/313 R; 23/313 AS; 252/91; 252/140; 252/174; 252/174.13; 252/384; 252/385; 427/215; 427/219; 427/220; 252/174.21; 252/174.25; 252/179; 252/383

[58] Field of Search ..... 252/80, 131, 140, 179, 252/174, 91, 174.13, 174.21, 174.25, 383, 384, 385; 23/313 R, 313 AS; 427/215, 219, 220, 214

[56] References Cited

U.S. PATENT DOCUMENTS

| | | | |
|---|---|---|---|
| 3,290,158 | 12/1966 | Treat | 252/385 |
| 3,755,180 | 8/1973 | Austin | 252/99 |
| 3,838,072 | 9/1974 | Smith | 252/540 |
| 3,868,336 | 2/1975 | Mazzola | 252/527 |
| 3,915,878 | 10/1975 | Yurko | 252/89 |
| 3,944,500 | 3/1976 | Gancy | 252/182 |
| 4,007,124 | 2/1977 | Collier | 252/109 |

FOREIGN PATENT DOCUMENTS

| | | | |
|---|---|---|---|
| 2507926 | 8/1975 | Fed. Rep. of Germany | 252/140 |
| 2535792 | 3/1976 | Fed. Rep. of Germany | 252/140 |
| 2538680 | 3/1976 | Fed. Rep. of Germany | 252/131 |

*Primary Examiner*—Dennis L. Albrecht

[57] ABSTRACT

A free flowing phosphate-free particulate heavy duty laundry detergent is comprised of particles of a mixture of sodium carbonate and sodium bicarbonate having nonionic detergent in the interior and on the surface thereof, to which is adhered a coating of smaller particles of ion exchanging zeolite. The product made is exceptionally free flowing and, although the particles are relatively large, is also of high bulk density (over 0.6 g./cc.). Also within the invention is a method of making such products by contacting the particles of mixed sodium carbonate and sodium bicarbonate with a normally liquid or pasty nonionic detergent in the liquid state so that the detergent is largely absorbed by the particles and coats the surfaces thereof, which are then coated with powdered zeolite which adheres to the surface nonionic of the particles and makes them free flowing.

9 Claims, No Drawings

PHOSPHATE-FREE CONCENTRATED PARTICULATE HEAVY DUTY LAUNDRY DETERGENT

This invention relates to improved free flowing phosphate-free, concentrated, particulate, heavy duty laundry detergents. More particularly, it relates to such products comprising sodium carbonate, sodium bicarbonate, normally liquid or pasty nonionic detergent and ion exchanging zeolite. Also, within the invention is a method for the manufacture of such products.

BRIEF DESCRIPTION OF THE INVENTION

This invention relates to a method of making a free-flowing particulate heavy duty laundry detergent having a bulk density of at least about 0.6 gm/c.c. comprising mixing together from about 20 to 40% of a mixture of sodium carbonate and sodium bicarbonate particles in a weight ratio in the range of from about 1:10 to 10:1, with from about 10 to 30% by weight of a nonionic detergent so that said nonionic detergent is absorbed by and coats the particles, and admixing with said nonionid detergent coated particles from about 40 to 60% by weight of zeolite particles such that said zeolite particles adhere to the detergent on the surfaces of the particles to provide a first formed particle; and applying a second coating of nonionic detergent to said first formed particle and then applying to said second nonionic detergent coating a coating of a zeolite particles to render said particles free flowing; wherein the ratio of said second nonionic detergent coating to zeolite particles postapplied to said first formed particle is in the range of from about 1:6 to about 3:4, said zeolite being a crystalline zeolite, amorphous zeolite or a mixture of crystalline and amorphous zeolites wherein the exchange rate and capacity of said zeolite is such that when about 375 ppm of said zeolite on an anhydrous basis is placed in water at 45° C. containing about 40 ppm of dissolved calcium ion while vigorously stirring the dissolved calcium ion content of the water is reduced to below about 8 ppm in about 5 minutes, said zeolite particles having ultimate particle diameters in the range of from about 0.01 to 20 microns; said nonionic detergent being a fatty-alcohol polyethylene oxide condensate which is a 10 to 18 carbon atom higher fatty alcohol alkoxylated with about 3 to 15 moles of ethylene oxide per mole of the higher fatty alcohol.

DETAILED DESCRIPTION OF THE INVENTION

Heavy duty powdered laundry detergents based on synthetic organic detergents and builder salts are well known and have been employed extensively as household and commercial detergents for washing soiled clothing and other such items. Although sodium tripolyphosphate is among the best of a variety of builder salts employed in such heavy duty detergents, phosphate contents of detergent compositions have been limited by law and regulations in view of evidence which has been interpreted to indicate that phosphates contribute to eutrophication of inland waters when discharged into such waters either directly or indirectly. Accordingly, substitute builders have been sought. Among the substitutes recently tried are the zeolites, particularly the molecular sieve zeolites which are sodium aluminosilicates of high calcium ion exchanging capacities. Sodium carbonate is a known builder for synthetic organic detergents and sodium bicarbonate has also been employed in detergent compositions. Nonionic detergents have recently found increased favor as principal organic detergents in laundry products whereas previously they were usually employed, if at all, as supplements for anionic organic detergents.

It is known that high bulk density detergents can be made but these very often have been objectionably fine powders which can "smoke", causing sneezing and eye irritation, when they are poured out of a box or other container during use. Attempts have been made to produce free flowing and dust-free particulate detergent compositions of increased concentrations of active ingredients and increased bulk densities so that comparatively small quantities thereof could be employed and detergent boxes could be diminished in size but so far as is known, until the present invention, none of such compositions was like the present invention, which is phosphate-free, yet of excellent detergency, non-caking, freely flowable and capable of being made by simple, currently practiced methods, in new applications and combinations.

In accordance with the present invention a free flowing, phosphate-free, particulate, heavy duty laundry detergent of bulk density of at least 0.6 g./cc. and particle sizes in the range of 4 to 40 mesh will comprise particles of mixed alkali metal carbonate and alkali metal bicarbonate having a normally liquid or pasty nonionic detergent in the interiors and on the surfaces of such carbonate-bicarbonate particles and coated with ion exchanging zeolite particles, the alkali metal carbonate and alkali metal bicarbonate particles initially being of particle sizes in the range of about 20 to 100 mesh, U.S. Sieve Series, and the final particle sizes being in the 4 to 40 mesh range. Also within the invention is a method for the manufacture of such compositions which includes having a normally liquid or pasty nonionic detergent, in the liquid state, absorbed by mixed particles of alkali metal carbonate and alkali metal bicarbonate which are then coated with a finer ion exchanging zeolite. Plural coating processes are also within the invention and allow the production of free flowing products of higher nonionic detergent content.

The products of this invention are excellent phosphate-free, concentrated, particulate, heavy duty laundry detergents of high bulk densities, making it possible to utilize small volumes thereof, e.g., 50–125 cc., for an average wash in an automatic washing machine (which has a tub volume of about 65 liters and washes a charge of about 4 kg. of soiled garments, etc.). Thus, smaller packages may be employed for similar effective quantities of detergent compositions and shelf space may be conserved in the supermarket and in the home. Of course, it is also easier to handle the smaller packages and to pour from them, resulting in more convenience and less spillage.

The zeolites which may be employed in practicing the present invention include the crystalline, amorphous and mixed crystalline-amorphous zeolites of both natural and synthetic origins which are of satisfactorily quick and sufficiently effective activities in counteracting hardness ions, such as calcium ions, in wash waters. Preferably, such materials are capable of reacting sufficiently rapidly with hardness cations, such as calcium, magnesium, iron and the like or any one of them, to soften wash water before adverse reactions of such hardness ions with other components of the synthetic organic detergent composition occur. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eq./g. and a hardness depletion rate residual hardness of 0.02 to 0.05 mg. $CaCO_3$/-liter in one minute, preferably 0.02 to 0.03 mg./l., and less than 0.01 mg./l. in 10 minutes, all on an anhydrous zeolite basis.

Although other ion exchanging zeolites may also be utilized normally the finely divided synthetic zeolite builder particles employed in the practice of this invention will be of the formula $$(Na_2O)_x \cdot (Al_2O_3)_y \cdot (SiO_2)_z \cdot wH_2O$$

wherein x is 1, y is from 0.8 to 1.2, preferably about 1, z is from 1.5 to 3.5, preferably 2 to 3 or about 2 and w is from 0 to 9, preferably 2.5 to 6.

The water soluble crystalline aluminosilicates used are often characterized by having a network of substantially uniformly sized pores in the range of about 3 to 10 Angstroms, often being about 4 A (normal), such size being uniquely determined by the unit structure of the zeolite crystal. Of course, zeolites containing two or more such networks of different pore sizes can also be satisfactorily employed, as can mixtures of such crystalline materials with each other and with amorphous materials, etc.

The zeolite should be a univalent cation-exchanging zeolite, i.e., it should be an aluminosilicate of a univalent cation such as sodium, potassium, lithium (when practicable) or other alkali metal, or ammonium. Preferably the univalent cation of the zeolite molecular sieve is an alkali metal cation, especially sodium or potassium and most preferably, is sodium, but various other types are also useful.

Crystalline types of zeolites utilizable as good ion exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text *Zeolite Molecular Sieves* by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the zeolite used in the invention is synthetic and it is also preferable that it be of type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4% up to about 36% of the zeolite total weight, depending on the type of zeolite used. The water-containing hydrated form of the molecular sieve zeolite (preferably about 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient temperature so that their water contents are in the range of about 5 to 30% moisture, preferably about 10 to 25%, such as 17 to 22%. However, the moisture content of the molecular sieve zeolite being employed may be much lower, as was previously described.

The zeolites used in this invention should usually also be substantially free of adsorbed gases, such as carbon dioxide, since such gas-containing zeolites can produce undesirable foaming when the zeolite-containing detergent is contacted with water; however, sometimes the foaming is tolerated and it may sometimes be desirable.

Preferably the zeolite should be in a finely divided state with the ultimate particle diameters being up to 20 microns, e.g., 0.005 or 0.01 to 20 microns, preferably being from 0.01 to 15 microns and especially preferably of 0.01 to 8 microns mean particle size, e.g., 3 to 7 or 12 microns, if crystalline, and 0.01 to 0.1 micron, e.g., 0.01 to 0.05 micron, if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily cover the carbonate-bicarbonate base particles.

Although the crystalline synthetic zeolites are more common and better known, amorphous zeolites may be employed instead and are often superior to the crystalline materials in various important properties, as will be described, as may be mixed crystalline-amorphous materials and mixtures of the various types of zeolites described. The particle sizes and pore sizes of such materials may be like those previously described but variations from the indicated ranges may be made, as described, providing that the materials function satisfactorily as builders and do not objectionably overwhiten dyed materials with which they are treated in aqueous media.

Various suitable crystalline molecular sieve zeolites are described in U.S. patent applications of Bao-Ding Cheng, Ser. Nos. 467,688, filed May 7, 1974; 503,734, filed Sept. 6, 1974; and 640,793 and 640,794, filed Dec. 15, 1975, all of which are hereby incorporated by reference for such descriptions and for descriptions therein of other materials within this invention. Other useful such molecular sieve zeolites are illustrated in German Offenlengungsschriften Nos. 2,412,837 and 2,412,839 and in Austrian patent applications A 3277/73; A 5458/73; A 5757/73; A 7160/73; A 8237/73; A 9450/73; A 9449/73; all of which are also incorporated herein by reference.

A preferred ion exchange zeolite is the amorphous zeolite of Belgian Pat. No. 835,351 of the formula $M_2O.Al_2O_3.(SiO_2)_z.wH_2O$ wherein z is from 2.0 to 3.8 and w is from 2.5 to 6, especially when M is sodium. Such patent and applications are also incorporated herein by reference to avoid the necessity for lengthy recitations of such materials, methods for their manufacture and uses, etc.

The mixture of alkali metal carbonate and alkali metal bicarbonate is very preferably a mixture thereof wherein both types of compounds are present in the same individual beads or particles. For the purpose of this invention such particles should desirably have sizes within the 20 to 100 mesh range, preferably being 30 to 60 mesh and most preferably about 40 mesh (the word "mesh" is used interchangeably with "No."). Larger particles, up to about 8 mesh, may be used providing that the resulting final product size is in the desired range. In some such cases efforts will be made to prevent any agglomeration or appreciable size growth taking place during absorption of nonionic detergent or else the final particle sizes will usually be too large. When sizes smaller than those in the desirable range indicated are used there is sometimes produced an unacceptable pasty product, rather than individual free flowing beads.

The alkali metal (sodium or potassium being preferred) carbonates and bicarbonates, most preferably as the sodium salts, will be essentially anhydrous in preferred embodiments of the invention but partially hydrated builder salts of this type may be tolerated. Normally, moisture contents will be less than 9%, preferably less than 7%. The proportion of alkali metal carbonate to alkali metal bicarbonate, by weight, will generally be within the range of 1:10 to 10:1, preferably being within the range of 1:5 to 1:1, more preferably in that of 1:3 to 1:1 and most preferably about 1:2. The mixed product is preferably made by a method which results in a substantial content, e.g., 10 to 100% of Wegscheider's salt, with any balance being sodium bicarbonate. Such a product is of excellent sorptive powers for liquid nonionic detergent and may be readily converted into a suitable base for a zeolite builder powder coating. A method for the manufacture of a mixed carbonate-bicarbonate product used successfully is shown in U.S. Pat. No. 3,994,500 of Gancy et al., hereby incorporated by reference. A useful mixed carbonate-bicarbonate of the type described is available from Allied Chemical Corporation under the name Snowlite®. Although the method of the patent is a preferable one the mixed carbonate-bicarbonate beads may be made by other techniques. In one aspect of this invention instead of the carbonate and bicarbonate being intimately associated in single beads separate charges of carbonate and bicarbonate may be utilized, preferably of the same sizes and proportions as for the products described above, providing that they are sufficiently sorptive to take up the nonionic detergent in sufficient quantity to produce the desired final products. Also, one may employ more finely divided carbonate and bicarbonate powders, such as those of particle sizes below 100 mesh, e.g., 170 to 270 mesh, and agglomerate these, either separately or in mixture, with care being taken to preserve the porosity of the product by employing only minimum amounts of a binder, such as starch or other agglomerating agent. Wegscheider's salt may also be added to such products.

The nonionic detergents include those described at length in McCutcheon's *Detergents and EMULSIFIERS*, 1973 Annual and in *Surface Active Agents*, Vol. II, by Schwartz, Perry and Berch (Interscience Publishers, 1958), the descriptions of which are hereby incorporated by reference. Such nonionic detergents are usually pasty or waxy solids at room temperature (20° C.) which are either sufficiently water soluble to dissolve promptly in water or will quickly melt at the temperature of the wash water, as when that temperature is above 40° C. The nonionic detergents employed will normally be those which are liquid or pasty at room temperature but preference will be given to normally pasty or semi-solid products because such are less liable to make a tacky product of poor flow properties and susceptibility toward lumping or setting on storage. Also they are less liable to weep and release their "holds" on the zeolites. Still, normally liquid nonionic detergents may be employed and nonionic detergents used will be liquefiable so that they may be sprayed at reasonable temperatures, such as those below 45°, 50° or 60° C. Typical useful nonionic detergents are the poly-(lower alkenoxy) derivatives that are usually prepared by the condensation of lower (2 to 4 carbon atoms) alkylene oxide, e.g., ethylene oxide, propylene oxide (with enough ethylene oxide to make a water soluble product), with a compound having a hydrophobic hydrocarbon chain and containing one or more active hydrogen atoms, such as higher alkyl phenols, higher fatty acids, higher fatty mercaptans, higher fatty amines and higher fatty polyols and alcohols, e.g., fatty alcohols having 8 to 20 or 10 to 18 carbon atoms in an alkyl chain and alkoxylated with an average of about 3 to 30, preferably 3 to 15 or 6 to 12 lower alkylene oxide units. Preferred nonionic surfactants are those represented by the formula $RO(C_2H_4O)_nH$, wherein R is the residue of a linear saturated primary alcohol (an alkyl) of 10 or 12 to 18 carbon atoms and n is an integer from 3 or 6 to 15. Typical commercial nonionic surface active agents suitable for use in the invention include Neodol® 45-11, which is an ethoxylation product (having an average of about 11 ethylene oxide units) of a 14 to 15 carbon atoms (average) chain fatty alcohol (made by Shell Chemical Company); Neodol 27-7, a 12 to 15 carbon atom chain fatty alcohol ethoxylated with an average of 7 ethylene oxide units; and Alfonic® 1618-65, which is a 16 to 18 carbon alkanol ethoxylated with an average of 10 to 11 ethylene oxide units (Continental Oil Company). Also useful are the Igepals® of GAF Co., Inc. Such materials are usually the polyethoxylated (3 to 30 ethylene oxide units) middle alkyl (6 to 10 carbon atoms) phenols, such as Igepals CA-630, CA-730 and CO-630. The Pluronics® (made by BASF-Wyandotte), such as Pluronic F-68 and F-127, which are condensates of ethylene oxide with hydrophobic based formed by condensing propylene oxide with propylene glycol, usually having molecular weights in the range of 5,000 to 25,000, may also be employed, as may be the various Tweens® (products of ICI America), which are polyoxyethylene sorbitan higher fatty acid (12 to 18 carbon atoms) esters, such as those containing solubilizing quantities of ethylene oxide therein. Various other nonionic detergents described in the texts previously incorporated by reference may also be employed but preferably the proportion of nonionic detergent or surface active agent present, when other than the higher fatty alcohol polyoxyethylene ethanols, will be a minor one, rarely being more than 50% and preferably no more than 25% of the total nonionic detergent content. In the above description higher, as in higher alkyl, higher fatty, etc., means from 8 to 20, preferably from 10 or 12 to 18.

In addition to the alkali metal carbonate-alkali metal bicarbonate combination builder salts various other builders may also be present, preferably inorganic builder salts such as alkali metal borates and silicates but organic builders are also useful, such as sodium citrate, trisodium nitrilotriacetate, CMOS (sodium carboxymethyl oxysuccinate), sodium gluconate and sodium EDTA. However, the total content of such non-carbonate, non-bicarbonate builders should usually be a minor proportion of the total builder content, preferably being less than 25% and more preferably less than 10% thereof. Ideally, in the usual case, the only builder system present will be the mixture of carbonate and bicarbonate. Of course, such mixture may be partly of sodium salts and partly of potassium salts, in any combination, but normally all-sodium salt mixes are preferred. Although a primary object of the present invention is to make a non-phosphate detergent of acceptable heavy duty cleaning power and with the other mentioned desirable characteristics, in some situations, as when some phosphate can be tolerated, part of the builder salt content may be pentasodium tripolyphosphate or other alkali metal polyphosphate. Usually, however, no more than 25% and preferably no more than 10% of the total builder content will be of such phosphate(s). When a non-phosphate builder is utilized with the mixture of carbonate and bicarbonate it will preferably be an alkali metal silicate, such as sodium silicate of $Na_2O:SiO_2$ ratio in the range of 1:1.6 to 1:3.0, preferably 1:2.0 to 1:2.7 and most preferably about 1:2.4. Such builder also functions as an anti-corrosion agent.

Although a nonionic synthetic organic detergent is an important component of the present products such may be partially replaced or supplemented by an anionic organic detergent or a mixture thereof and in some cases by amphoteric organic detergents, too. However, the nonionic compound(s) will constitute a major proportion of the detergent present and normally the proportion of anionic detergent and/or amphoteric detergent in the final product will be less than 10%. Most preferably, only nonionic detergent is employed. The anionic detergent and/or the amphoteric detergent, if such is/are used, may be suitably combined with the nonionic detergent being sprayed onto the surfaces of the carbonate-bicarbonate beads. Sometimes a satisfactorily powdered anionic or amphoteric detergent may be mixed with the mixture of carbonate and bicarbonate before admixing with nonionic detergent. Also, particulate builder salts and other adjuvants may be incorporated into the composition in ways similar to those described above for the anionic and/or amphoteric detergents and additionally, in some cases, aqueous solutions or dispersions of such builder salts, when employed in relatively small quantities, may be deposited on the zeolite powder, before it is used to coat the base particles, being dehydrated by the zeolite and being converted to particulate form. However, normally it will be preferable to omit prior mixing of any other components with the zeolite before application thereof to the combination builder salt-nonionic detergent product. Still, comparatively small quantities of adjuvants, such as perfumes, fluorescent brighteners and colorants may be post-applied, although it is usually preferred to incorporate adjuvants with the carbonate-bicarbonate mixture (unless they may be reacted with it or adversely affected by it) or with the nonionic detergent.

Among the anionic detergents that are useful are the sulfates and sulfonates of lipophilic moieties, especially those containing higher carbon atom chains, such as those of 8 to 20 or 10 to 18 carbon atoms. Included among such compounds are the linear higher alkylbenzene sulfonates, olefin sulfonates, paraffin sulfonates, fatty acid soaps, higher fatty alcohol sulfates, higher fatty acid monoglyceride sulfates, sulfated condensation products of ethylene oxide (3 to 30 mols per mol) and higher fatty alcohol, higher fatty acid esters of isethionic acid and other known anionic detergents, such as also are mentioned in the texts previously incorporated herein by reference. Most of these products are normally in solid form, usually as the alkali metal, e.g., sodium, salts and may be spray dried with usual builders. Agglomeration techniques, size reduction, pilling and other methods may be employed to make such intermediate products of sizes like those of the carbonate-bicarbonate particles. A few examples of suitable anionic detergents include sodium linear tridecyl benzene sulfonate, sodium cocomonoglyceride sulfate, sodium lauryl sulfate and sodium paraffin and olefin sulfonates, each of an average of about 16 carbon atoms.

While amphoteric compounds such as the sodium salt of Miranol® $C_2M$ and Deriphat® 151 may be employed in the present detergents in replacement of all or part, e.g., up to 50%, of any anionic detergent used, usually no amphoteric detergent will be present. Like the anionic detergents, the amphoterics may be spray dried or otherwise co-formed with a builder, such as tripolyphosphate or may be dispersed in the liquid nonionic detergent or suitably mixed with other powders during the making of the present products.

Various adjuvants, both functional and aesthetic, may be included in the present compositions, such as bleaches, e.g., sodium perborate; colorants, e.g., pigments, dyes; fluorescent brighteners, e.g., stilbene brighteners; foam stabilizers, e.g., alkanolamides, such as lauric myristic diethanolamide; enzymes; e.g., proteases; skin protecting and conditioning agents, such as water soluble proteins of low molecular weight, obtained by hydrolysis of proteinaceous materials, such as animal hair, hides, gelatin, collagen; foam destroyers, e.g., silicones; bactericides, e.g., hexachlorophene; and perfumes. Usually such adjuvants and any supplemental builders will be admixed with the other components at a particular stage in the manufacturing process which is most suitable, which usually depends on the nature of the adjuvant and its physical state. Particularly desirable will be additions which help to stabilize the adjuvant or other components of the product and/or which increase the power of the carbonate-bicarbonate mixture to absorb nonionic detergent.

Various other useful detergents and adjuvants are described in U.S. patent application Ser. No. 751,124 for Readily Disintegrable Agglomerates of Insoluble Detergent Builders and Detergent Compositions Containing Them, filed Aug. 17, 1976, by Bao-Ding Cheng, hereby incorporated by reference.

Proportions of carbonate-bicarbonate particles, zeolite and nonionic detergent in the product should be chosen to result in the desired free-flowing detergent particles of satisfactory high bulk density, when made by the method of this invention. Such proportions are 20 to 40% of mixed alkali metal carbonate and alkali metal bicarbonate, 40 to 60% of zeolite and 10 to 30% of nonionic detergent, with preferred ranges being 25 to 35%, 45 to 55% and 15 to 25%, respectively. The bulk density of the product will be at least 0.6 g./cc., preferably being in the range of 0.75 to 0.95 g./cc. and most preferably being in the 0.8 to 0.9 g./cc range. The particle sizes of the product will usually be in the range of 4 to 40 mesh, preferably being from 4 to 12 mesh and most preferably being about 6 or 8 mesh. The particle sizes of the carbonate-bicarbonate starting material, before any treatment, will usually be in the range of about 20 to 100 mesh, preferably 30 to 60 mesh and most preferably about 40 mesh. However, as was previously mentioned, finer carbonate and bicarbonate powders may be employed initially and may be agglomerated up to the mentioned sizes. Generally, the materials within the mesh ranges given will constitute a mixture of products of different particle sizes within such ranges (this is usual for the various particulate materials described herein) rather than a product of a single particle size.

In the manufacture of the starting carbonate-bicarbonate mix particles the method of U.S. Pat. No. 3,944,500 may be employed and the product thereof, identified by the trade name Snowlite, obtainable from Allied Chemical Corporation, is preferably used. A typical analysis for Snowlite I is 35% $Na_2CO_3$, 58.5% $NaHCO_3$ and 6.5% $H_2O$ whereas that for another such product, Snowlite II, is 30.0, 66.5 and 3.5%, respectively. Screen analyses (percentages on No. 10, 40, 60 and 100 screens) are 0.2, 67.6, 96.6, 99.0 and 0.7, 60.7, 90.7 and 97.0, respectively. Bulk densities (g./cc.) are 0.51 and 0.48 respectively (tamped) and 0.42 and 0.38 (untamped). Friability is especially low for Snowlite I (2.5% by Allied Chemical Corp. test Na 17-35) and such product is preferred. In some cases other components of the final product may be included in the mix of bicarbonate and Wegscheider's salt being processed by the patent method, providing that they are stable and do not adversely react or interfere with the making of the carbonate-bicarbonate product. Normally the carbonate-bicarbonate particles will contain at least 60%, preferably 70% and more preferably from 70 to 85% or more of carbonate and bicarbonate, when such other adjuvants are present, such as 10 to 20% of sodium silicate and/or 0.1 to 5% of fluoroescent brightener, sometimes with 5 to 15% of water, too.

The free flowing, phosphate-free, particulate, high bulk density, heavy duty laundry detergents of this invention are easily made by admixing the described sodium carbonate-sodium bicarbonate particles with a nonionic detergent in liquid form. The detergent penetrates the carbonate-bicarbonate particles but leaves a portion thereof on the particle surfaces to which subsequently admixed zeolite may adhere. The nonionic detergent, normally a liquid or pasty one, preferably being pasty or semi-solid, is preferably sprayed onto the moving surfaces of the carbonate-bicarbonate particles, after which the zeolite powder is admixed therewith. The proportions of materials utilized are such that the product made will be of a desired, previously described composition.

The initial spraying or other mixing of nonionic detergent with the carbonate-bicarbonate particles is normally effected with the particles at about room temperature (20° to 25° C.) but the temperature may vary over the ranges of 10° to 40° or 50° C. The spraying and admixing may take as little as 1 to 5 minutes and mixing may be continued after completion of the spraying for a period of 0 to 10 minutes, preferably 1 to 5 minutes. The higher fatty alcohol-polyethylene oxide condensation product being sprayed onto the surfaces of the moving beads is usually heated to an elevated temperature so that it is liquid and is sprayed onto the moving surfaces or otherwise applied to them so as to distribute it over them and promote absorption of the liquid into the porous particles. Additionally, some agglomeration may be effected during the initial mixing, apparently being due to adhesion or cohesion between some of the finer particles present which have "excessive" amounts of liquid nonionic detergent at the surfaces thereof. During such agglomeration such particles may be increased in size to sizes approximately in the range of the final product, although the subsequent adhesion of zeolite particles does further increase the particle sizes somewhat. Preferably the mixing and spraying of the nonionic detergent onto the moving particles are effected in a rotating drum or tube inclined at a slight angle, such as 5° to 15°. The rotational speed may be any that is suitable, such as 5 to 50 r.p.m. The spraying of the nonionic detergent will normally be such as to produce fine droplets of such detergent, such as those of diameters in the 40 to 200 micron diameter range, preferably 50 to 100 microns but other suitable spray droplet sizes may also be produced and in some cases the nonionic may be blended with the mixed carbonate-bicarbonate particles after being dropped or poured onto the moving surfaces thereof. In such cases one may employ a higher speed or higher energy mixer such as a Lodige mixer, operating at comparatively low speed, or a twin shell or similar type mixer, to prevent excessive agglomeration of particles caused by addition of the larger droplets or streams of nonionic detergent. As was previously indicated, although it is not preferred, sorptive carbonate-bicarbonate particles could be made by methods other than those herein described, wherein more angular products result, but it is highly desirable for the particles to be flowable and most preferably they are somewhat rounded.

After completion of the sorption of the nonionic and holding of the zeolite powder to the surfaces of the carbonate-bicarbonate beads the product, which may have a moisture content of 2 to 20%, preferably 5 to 15% (including hydrating water), is ready for packaging. As was previously mentioned, various adjuvants can be incorporated in the product by inclusion with suitable components or may be added thereto in suitable processing steps during the production of the free flowing beads or after such production is essentially complete. The total adjuvant content, excluding water, will rarely exceed 20% of the product and will normally be less than 10%. Of course, if a perborate bleach is utilized the percentage thereof may be increased to an effective bleaching amount, which can be as high as 30% of the product, normally with the proportions of the other important components being proportionately diminished accordingly. The perborate may be comixed with the carbonate-bicarbonate mixture or may be post-added to the nonionic-treated mix or to the final product. Colorants, perfumes and other adjuvants may be admixed with the various components and mixtures during manufacture or after completion thereof, too.

The products of this invention have significant advantages over phosphate-containing and low phosphate heavy duty detergents because they are satisfactorily detersive against a variety of soils normally found on household items to be washed and yet comply with legislative and administrative rulings restricting the use of phosphates in detergents. Thus, a product of the present formula may be employed nationwide and there is no need for several formulations and restricted shipments of detergent compositions to different areas in the country. The satisfactory detergency is due to the presence of a sufficient content of organic detergent and the mixed carbonate-bicarbonate and zeolite builders. Normally, one would expect that the comparatively high concentrations of nonionic detergents, which are in themselves usually liquid or pasty, would cause the product to be "lazy" or poorly flowing, with a tendency to cake on storage, but due to the application of the nonionic to the mixed carbonate-bicarbonate beads in liquid form and its penetration to the interiors of such base particles, with subsequent coating of any nonionic on the surface by the finely divided zeolite powder, a very free flowing and non-caking product is obtained. The mixture of carbonate and bicarbonate in the base beads provides the builder action for the present compositions and at the same time is a desirable base for sorption of the nonionic detergent. The presence of the bicarbonate lowers the normally excessively high pH that would otherwise be obtained by use of carbonate alone and makes the product safer for use. It also significantly improves the power of the composition to sorb nonionic detergent. The zeolite powders on the surfaces of the particles, in addition to preventing the nonionic detergent from causing tackiness or poor flow, also protect the product interiors against the action of external moisture under humid conditions. Thus, the compositions may be marketed without the use of special wax coated barrier cartons. The zeolite, because of its affinity for moisture, takes up such moisture before it can penetrate to the interior of the particle, where it might have an adverse effect on the bicarbonate or carbonate or where it could, due to the creation of moist alkaline conditions, adversely affect some of the other product constituents, such as adjuvants. The ion exchanging zeolite, being on the exteriors of the particles and being quickly effective to remove calcium ion from the wash water, acts to remove any possibly harmful calcium ions (and other hardness ions) before they can react with any other detergent components, such as adjuvants. Also, because they are intimately associated with the nonionic detergent the zeolites are maintained in suspension by the nonionic during the initial period of contact with the wash water, at which time they will normally be of a particle size considerably larger than their ultimate particle size and therefore more likely to be entrapped in the laundry, which is objectionable because they might tend to lighten the appearance of dark colored laundry items when deposited thereon. The nonionic detergent helps to keep the zeolite particles suspended until they break down to smaller particle sizes which are not as apt to be deposited on the laundry. The comparatively large particle sizes of the product and of the starting materials are somewhat unusual but result in free flowing particles which still dissolve rapidly and are of high bulk density. Because of the comparatively large particle sizes of the carbonate-bicarbonate mix better absorption of nonionic results, together with desirable coating action, not objectionable paste formation, and the surfaces of the particles contain enough nonionic to hold the desired coating of zeolite powder.

The following examples illustrate various embodiments of the invention but it is not considered as being limited to them. Unless otherwise mentioned all parts are by weight and all temperatures are in °C.

EXAMPLE 1

| | Percent |
|---|---|
| Mixed sodium carbonate-sodium bicarbonate building particles (Snowlite I, about 1:2 weight ratio of $Na_2CO_3$ to $NaHCO_3$, of particle sizes in the 20 to 100 mesh range, U.S. Standard Sieve Series) | 30 |
| Neodol 25-7 (nonionic detergent condensation product of $C_{12-15}$ higher fatty alcohol with an average of 7 mols ethylene oxide, mfd. by Shell Chemical Company) | 20 |
| Type 4A high ion exchange capacity crystalline zeolite (Zeolite CH-252-91-1, of particle sizes in the 170 to 270 mesh range, with ultimate particle sizes in the 3 to 7 micron range, averaging about 5.2 microns, mfd. by J. M. Huber Corp.) | 50 |

The building carbonate-bicarbonate beads are charged at room temperature (25° C.) to an inclined drum of 8° inclination, rotating at a speed of about 40 r.p.m. and over a period of five minutes the nonionic detergent is sprayed onto the moving surfaces of the particles, after which mixing in the drum is continued for another five minutes, after which time the zeolite powder is admixed with the product, usually over another five minutes. The nonionic spray is in the form of droplets largely in the range of 50 to 100 microns in diameter and during the spraying and subsequent admixing the particle sizes of the contents of the mixer increase slightly and any fines present are agglomerated to be within the 20 to 100 mesh range. The zeolite addition is effected over a period of about five minutes (times of 1 to 10 minutes are typical) and at the end of that time the intermediate product particle sizes are in about the 4 to 40 mesh range, the untamped bulk density is about 0.8 g./cc. and the detergent is exceptionally free flowing. The product is packaged and stored and is found not to develop objectionable cakes or lumps on storage. Also, after normal storage times under actual storage conditions when the package is opened the detergent pours readily and the bulk density remains at about 0.8 g./cc.

When subjected to actual use washing tests or practical laundry tests, it is found that the detergent composition is non-dusting, free flowing, non-caking and of acceptable detergency for commercial applications, comparing favorably to tripolyphosphate-built products of similar active ingredient contents. The zeolite does not objectionably deposit on nor whiten dark colored laundry and the carbonate does not have any adverse effects on materials washed, due to the presence of the bicarbonate, which results in the wash water having a pH of about 9.8.

In a comparative experiment finely divided sodium carbonate and sodium bicarbonate powders, of particle sizes in the 170 to 270 mesh range are used and agglomerated to a particle size in the 4 to 40 mesh range by preliminary treatment with 5% by weight of a 20% cornstarch paste (aqueous) sprayed onto moving particles of the powdered carbonate and bicarbonate in the same mixing drum previously described, over a period of about three minutes, with the drum moving at slow speed, e.g., 10 r.p.m. The product resulting is a useful detergent at the same concentration used for the previous experiment (¼ cup or about 45 grams per 65 liter tub of wash water), washing a charge of about 4 kg. of soiled garments, but is not as free flowing as the previously described detergent. When only sodium bicarbonate is used as a starting builder salt with the zeolite the product does not wash as well as the described preferred product and when the carbonate alone is employed the product is more alkaline than desirable and is not as free flowing. However, the carbonate-containing composition does have utility as a detergent in applications wherein higher pH's can be tolerated, although on the retail market it would not be as acceptable as the preferred products of the present invention because of its comparatively poorer flow characteristics and higher pH.

EXAMPLE 2

| | Percent |
|---|---|
| Snowlite I | 20 |
| Britesil ® hydrous silicate particles (18% $H_2O$, $Na_2O:SiO_2$ ratio of 1:2, mfd. by Philadelphia Quartz Company) | 10 |
| Neodol 25-7 | 15 |
| Type 4A zeolite (Zeolite CH-252-91-1, mfd. by J. M. Huber Corp.) | 55 |

The Snowlite particles are charged at room temperature to the inclined drum of Example 1, rotating at 12 r.p.m. The hydrous silicate, desirably of approximately the same particle size, is added to the drum, while mixing, over a period of about two minutes and mixing is continued for another three minutes to blend the silicate evenly with the carbonate-bicarbonate particles. Then, over a period of another five minutes the nonionic detergent, at a temperature of about 40° C., compared to the 30° C. of Example 1, is sprayed onto the moving surfaces of the particles. The procedure from this point on is the same as in Example 1. The product resulting is an excellent concentrated heavy duty, non-phosphate detergent, useful in the washing of laundry at a concentration of 0.1 to 0.2% in the wash water (0.15% is most frequently employed in top-loading washing machines). The product is of a bulk density of about 0.7 to 0.8 g./cc. and is free flowing after normal storage. The hydrous silicate content helps to increase the building effects of the detergent and improves the anti-corrosion activity thereof too, compared to the product of Example 1, although that product is also satisfactory in both such respects.

EXAMPLE 3

| | Percent |
|---|---|
| Snowlite I | 30 |
| Neodol 25-7 | 20 |
| Neodol 25-3S (sodium polyethoxy higher fatty alcohol sulfate [$C_{12-15}$ alcohol and 3 mols of ethylene oxide per mol], 60% active ingredient, 25% $H_2O$ and 15% $C_2H_5OH$, mfd. by Shell Chemical Company) | 4 |
| Type 4A zeolite (Zeolite CH-252-91-1, mfd. by J. M. Huber Corp.) | 46 |

The manufacturing procedures of Examples 1 and 2 are followed, where applicable, with the exception that the Neodol 25-3S is mixed with the Neodol 25-7 and both are sprayed onto the Snowlite particles together. The product resulting is an excellent heavy duty detergent, free flowing, non-tacky, non-lumping on storage and of desirable high bulk density (0.6 to 0.8 g./cc.) Due to the content of additional anionic detergent this product is a slightly better washing agent than that of Example 1.

In a modification of the described experiment 0.5% of fluorescent brightener (Tinopal 5BM) replaces a similar percentage of Neodol 25-3S and is mixed with the Snowlite before application of Neodol 25-7 and Neodol 25-3S thereto. It is tightly held to the Snowlite particles by the nonionic detergent, being of smaller particle size, like that of the zeolite, and is protected by the nonionic detergent, anionic detergent and zeolite from immediate contact with items being washed, thereby inhibiting any objectionable premature, concentrated deposition of fluorescent brightener on the laundry.

EXAMPLE 4

This example describes a further modification in the products and methods of this invention, wherein additional quantities of nonionic detergent are capable of being incorporated in the product by utilization of sequential coating techniques. In Examples 1–3 above the liquid nonionic detergent is applied in sufficient quantity so that it penetrates into the interiors of the Snowlite or other base particles, with such an excess present that it wets the surfaces of the particles so as to cause the zeolite powder to adhere to such surfaces. In some cases, when it is desired to employ more nonionic detergent in the product, making a more concentrated detergent composition, and the procedures of Examples 1–3 are followed, the excess liquid causes or promotes the production of an agglomerate or paste. By the method of this example such undesirable result is avoided and additional nonionic detergent is satisfactorily incorporated in the product, which is still free flowing and of high bulk density. Also, by this method the particle size may be increased desirably.

The procedures of Examples 1–3 are followed but in each case, based on 100 parts of product resulting from the practice of the methods of those examples, an additional five parts of the nonionic detergent are sprayed onto the product and an additional ten parts of zeolite are then mixed in with the product to be adhered to the nonionic coating thereon (using the spraying and mixing procedures described in Examples 1–3). The particle size increases about 5% (diameter) but the product is still of about the same bulk density as was previously obtained and still is free flowing and non-lumping. In further experiments, an additional five parts of the nonionic detergent are sprayed onto the two-stage product and an additional ten parts of the zeolite are dusted onto this, with similar desirable results (using the same spraying and mixing methods).

In the practice of the sequential enrichment and coating operations described, the Snowlite or other base particle will usually not be re-applied but this may be done when advantageous. Normally as many as six coating operations may be employed but it is preferred that this be limited to three such operations, as in the "further experiment" described herein. Also, it is preferred that the totals of nonionic detergent and zeolite in coating operations subsequent to the first operation should be limited to the amounts employed in the first operation and preferably to halves of such amounts, with proportions of the nonionic and zeolite being within the proportions of the previously mentioned percentage ranges.

EXAMPLE 5

The procedures of Examples 1–4 are repeated, with Snowlite II being substituted for Snowlite I, types X and Y crystalline zeolites of similar particle sizes and amorphous zeolites being substituted for the type 4A zeolite and Neodols 23-6.5 and 45-11 and Alfonics 1618-65 and 1412-60 being substituted for the Neodol 25-7, and comparable high bulk density, free flowing detergent compositions are made. The only changes in manufacturing techniques are in maintaining the temperature of the nonionic detergent sufficiently high to ensure that it is in the liquid state when it is sprayed onto the surfaces of the base particles. Additionally, proportions of the various components are modified ±10% and ±30%, while being kept within the ranges of percentages and proportions previously mentioned. Care is taken that the proportion of nonionic detergent employed is such as to provide an unabsorbed portion on the surface of the base beads in the form of an adhering coating so as to hold the zeolite particles. When the nonionic detergent is normally solid the temperature of the detergent at the time of application of the zeolite is maintained high enough so that the zeolite particles will adhere to it and the base particles.

The especially desirable results obtained in the above examples and in following the procedures of this invention to make the compositions thereof are unexpected. Although the employment of mixed sodium carbonate-bicarbonate products (each particle includes such a mixture) of the type described in U.S. Pat. No. 3,944,500 as absorbents for nonionic detergents had been suggested, there was no teaching that high bulk density products like those of this invention could be made using such nucleus particles. In fact, the Wegscheider's salt carbonate-bicarbonate materials, which often also include sesquicarbonate, are described as being of low bulk density (the range is about 0.4 to 0.5 g./cc.). In the present cases, although 0.6 g./cc. is considered to be a high bulk density (tamped) for detergent products, usually the products made in accord with this invention will have even higher densities, normally being about 0.7 g./cc. or higher. The presence of the zeolite particles and their being held to the base particles is not described in the prior art nor is the concept of utilizing sufficient liquid nonionic detergent to maintain a coating thereof on the base particles, despite the high sorption of liquid by such particles. By this method one makes a non-segregating, free-flowing product of desirable comparatively large particle size containing even more nonionic detergent than the base particles can normally hold. During the application of the nonionic detergent to the nucleus particles, which absorb much of the nonionic, the "excess" nonionic forms a coating on the surfaces of the particles which is of a greasy or waxy appearance and the particles do not agglomerate objectionably but do hold the smaller zeolite particles subsequently applied. The mix before addition of the zeolite is not pasty; rather, it resembles moist sand, with each particle unattached to other such particles or releasably attached. The final products made are free flowing despite the presence of 10 to 100% of the Wegscheider's salt needles in the base materials, partly because the coating of more finely divided zeolite helps to round them or make the particles spherical. Additionally, the relative locations of the various components in the product beads are desirable functionally and the buffering action of the base particles, when carbonate-bicarbonate is used, is helpful in washing (the pH of a 0.1% aqueous solution of the Snowlites is about 9.8).

It is considered to be important that the finished product particles are in the range of comparatively large sizes given but when, in the above examples, conditions are changed (usually by using smaller base particles) so that smaller particles result, e.g., those in the 8 to 100 mesh range, higher bulk densities than those of usual detergent compositions are obtained and the products made are useful in various detergent applications although they are not as free flowing or attractive as the preferred embodiments of this invention.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A method of making a free-flowing particulate heavy duty laundry detergent having a bulk density of at least about 0.6 gm/c.c. comprising mixing together from about 20 to 40% of a mixture of sodium carbonate and sodium bicarbonate particles in a weight ratio in the range of from about 1:10 to 10:1, with from about 10 to 30% by weight of a nonionic detergent so that said nonionic detergent is absorbed by and coats the particles, and admixing with said nonionic detergent coated particles from about 40 to 60% by weight of zeolite particles such that said zeolite particles adhere to the detergent on the surfaces of the particles to provide a first formed particle; and applying a second coating of nonionic detergent to said first formed particle and then applying to said second nonionic detergent coating a coating of zeolite particles to render said particle free flowing; wherein the ratio of said second nonionic deterent coating to zeolite particles post-applied to said first formed particle is in the range of from about 1:6 to about 3:4, said zeolite being a crystalline zeolite, amorphous zeolite or a mixture of crystalline and amorphous zeolites wherein the exchange rate and capacity of said zeolite is such that when about 375 ppm of said zeolite on an anhydrous basis is placed in water at 45° C. containing about 40 ppm of dissolved calcium ion while vigorously stirring the dissolved calcium ion content of the water is reduced to below about 8 ppm in about 5 minutes, said zeolite particles having ultimate particle diameters in the range of from about 0.01 to 20 microns; said nonionic detergent being a fatty-alcohol polyethylene oxide condensate which is a 10 to 18 carbon atom higher fatty alcohol alkoxylated with about 3 to 15 moles of ethylene oxide per mole of the higher fatty alcohol.

2. The method according to claim 1 wherein said zeolite is a crystalline zeolite selected from the group consisting of zeolite types 4A, X, and Y.

3. The method according to claim 1 wherein the ratio of sodium bicarbonate to sodium carbonate is about 1:2.

4. The method according to claim 1 wherein said first formed particle is sequentially coated from 2 to 5 times.

5. The method according to claim 1 wherein the rate and capacity of said zeolite are such that when 375 ppm of said zeolite is placed in water at 45° C. containing 40 ppm of dissolved calcium ion while vigorously stirring, the dissolved calcium ion content is reduced to below about 3 ppm within about 5 minutes.

6. The method according to claims 1 or 2 wherein the amount of zeolite and nonionic detergent post-applied to said first formed particle is about 5 parts by weight nonionic detergent and 10 parts by weight zeolite based on 100 parts by weight of said first formed particle.

7. The method according to claim 1 wherein said zeolite is a type 4A zeolite, said nonionic detergent is a fatty alcohol-polyethylene oxide condensate wherein the fatty alcohol is a $C_{12}$ to $C_{15}$ fatty alcohol with an average of 7 moles of ethylene oxide per mole of fatty alcohol; and the ratio of sodium carbonate to sodium bicarbonate is 1:2.

8. The method according to claims 1 or 2 wherein the amount of nonionic detergent coated onto said first formed particle is about one-half of the amount of nonionic detergent in said first formed particle, and wherein the amount of zeolite applied to said second nonionic detergent coating is about one-half the amount of zeolite in said first formed particle.

9. The method according to claims 1 or 2 wherein the amount of nonionic detergent coated onto said first formed particle is about equivalent to the amount of nonionic detergent in said first formed particle, and wherein the amount of zeolite applied to said second nonionic detergent coating is about equivalent to the amount of zeolite in said first formed particle.

* * * * *